US007014497B2

(12) United States Patent
Lange

(10) Patent No.: US 7,014,497 B2
(45) Date of Patent: Mar. 21, 2006

(54) TENSION SPRING CLIP COMPRISING SYMMETRICAL TENSION SPRINGS

(75) Inventor: Oliver Lange, Schieder-Schwalenberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 10/514,866

(22) PCT Filed: Nov. 11, 2003

(86) PCT No.: PCT/EP03/12580

§ 371 (c)(1),
(2), (4) Date: Nov. 15, 2004

(87) PCT Pub. No.: WO2004/047226

PCT Pub. Date: Jun. 3, 2004

(65) Prior Publication Data

US 2005/0250391 A1 Nov. 10, 2005

(30) Foreign Application Priority Data

Nov. 16, 2002 (DE) ..... 102 53 517

(51) Int. Cl.
*H01R 13/00* (2006.01)
*H01R 4/48* (2006.01)

(52) U.S. Cl. ..... 439/441; 439/834

(58) Field of Classification Search ..... 439/441, 439/436, 437, 438, 439, 440, 834, 835, 787
See application file for complete search history.

(56) References Cited

U.S. PATENT DOCUMENTS

| | | | | |
|---|---|---|---|---|
| 5,320,558 | A * | 6/1994 | von Roretz | 439/441 |
| 5,435,735 | A * | 7/1995 | Wittig et al. | 439/79 |
| 5,626,488 | A * | 5/1997 | Albeck et al. | 439/395 |
| 5,984,738 | A * | 11/1999 | Michelmann et al. | 439/786 |
| 6,283,801 | B1 * | 9/2001 | Guinda et al. | 439/835 |
| 6,743,061 | B1 * | 6/2004 | Jaegerskuepper | 439/834 |

OTHER PUBLICATIONS

International Search Report for PCT/EP03/ 12580.

* cited by examiner

*Primary Examiner*—Chandrika Prasad
(74) *Attorney, Agent, or Firm*—Bourque & Associates

(57) ABSTRACT

A draw spring clamp has loopshaped draw springs with an attachment leg to contact a current bus and with a spring leg and clamping leg, whereby the latter is interrupted by a clamp window in order to form the clamp leg. By means of an actuation element into which a tool blade may be inserted, the spring leg of the draw springs may be loaded with tension in order to open the clamp window. This actuation element is located between the two spring legs of the draw spring that oppose each other. In order to enable time-saving actuation, the actuation element in its loaded position also rests against the two spring legs. Thus, the actuation element possesses rest positions on its opposing exteriors whose separation increases along a first direction of travel of the actuation element and decreases along the second, direction.

6 Claims, 2 Drawing Sheets

TENSION SPRING CLIP COMPRISING SYMMETRICAL TENSION SPRINGS

TECHNICAL FIELD

The invention relates to a draw spring clamps with two draw springs positioned in mirror-image layout within a housing.

BACKGROUND INFORMATION

The invention relates to a draw spring clamps with two draw springs positioned in mirror-image layout within a housing. Each of these draw springs possesses an attachment leg resting on a current bus as well as a spring leg that is of one piece with it and that is bent together with the attachment leg into a loop. The attachment leg of the pertinent draw springs extends with its end and with the current bus through the clamp window. The two spring legs of the draw springs are positioned facing each other, and are loadable with tension by means of an actuation element that is positioned within a housing of the draw spring clamp into which a tool blade may be inserted for the purpose of providing spring tension along the direction toward the attachment leg when the clamp window is opened. The above-mentioned actuation element is located between the two opposing spring legs, and also rests in its tensioning position against both spring legs, and also possesses a corresponding rest position on opposing exterior sides for the spring legs of both draw springs.

This type of draw spring clamp is known generally. According to such devices, the actuation element is formed as an oval, rotatable body that correspondingly possesses a maximum diameter and a minimum diameter. In the rotational position of the actuation element at which the maximum diameter is located within the symmetry plane of the draw springs, their spring legs are not tensioned. In the position rotated by 90? in which the maximum diameter of the actuation element is perpendicular to the symmetry plane of the draw springs, their spring legs are tensioned with force and correspondingly are deflected toward each attachment leg of the draw spring, whereby the clamp windows of both draw springs are open. The actuation element includes an insertion slot for a screwdriver blade so that it may be rotated. This involves not only the rotation of the actuation element the rotational position to load the spring legs of the draw springs, from which rotational position the actuation element must be reset by means of a screwdriver blade.

Another type of draw spring is known wherein the actuation element is formed as a slider that may move along a guide formed by the clamp housing. This actuation element assumes an initial position in which it is located between the two opposing spring legs of the draw springs. From this initial position, it may be displaced to the one side toward the first draw spring, and to the other side toward the second draw spring, in order to tension the spring leg of the pertinent draw spring and to open the clamp window of the draw spring. Thus, the two clamp windows of the draw springs may be opened only sequentially.

A draw spring clamp of yet another type is known whereby two pivotable actuation pressers are present to tension the spring legs of the two draw springs that include pressure jaws into which engagement may occur using a screwdriver blade. These actuation pressers are formed as levers with unequal arms, whereby the presser jaw is located on the one lever arm to tension the spring leg of the pertinent draw spring. With this type of device, the clamp positions may also only be serviced sequentially, whereby here even the tool between the actuation pressers must be reset.

Draw spring, clamps of the above-mentioned type are particularly used as plug-in modules. Each of the two draw springs of the clamp hereby receives one of the two connection cables of a cabled module or the like.

SUMMARY

It is one goal of the invention to provide a draw spring clamp by means of which switching of such cabled modules is made especially simpler and less time-consuming, and in which reset of the actuation element is achieved automatically when the actuation tool is removed.

Such a goal is achieved by a draw spring clamp of the above-mentioned type in that the actuation element is formed as an elastic or partially elastic spreading body that may be stretched toward the spring legs of the draw spring by insertion of the tool blade using its exterior sides.

It is essential to the invention that the actuation element be formed as a spreading body that may be stretched bay the insertion of a conventional, wedge-shaped screwdriver blade, which resultantly applies force caused by this spreading to the two adjacent spring legs of the two draw spring clamps. Without multiple rotational or slide displacements, the two clamp positions in the area of the clamp window of the two draw springs are opened and closed simultaneously, by means of which a cabled module may be clamped by, or removed from, the draw spring clamp as a plug-in module with both connector cables also clamped by or removed from, the two draw springs. The elastic actuation element is reset automatically upon removal of the tool blade, thus releasing the spring legs of the draw springs again. This achieves a positive clamping of the cabled module since release of the draw springs with the actuation tool removed is not possible.

Thus, a draw spring clamp in accordance with the present invention has loop-shaped draw springs with an attachment leg to contact a current bus and with a spring leg and clamping leg, whereby the latter is interrupted by a clamp window in order to form the clamp leg. By means of an actuation element into which a tool blade may be inserted, the spring leg of the draw springs may be loaded with tension in order to open the clamp window. This actuation element is located between the two spring legs of the draw spring that oppose each other. In order to enable time-saving actuation, the actuation element in its loaded position also rests against the two spring legs. Thus, the actuation element possesses rest positions on its opposing exteriors whose separation increases along a first direction of travel of the actuation element and decreases along the second direction.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by the following claims.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
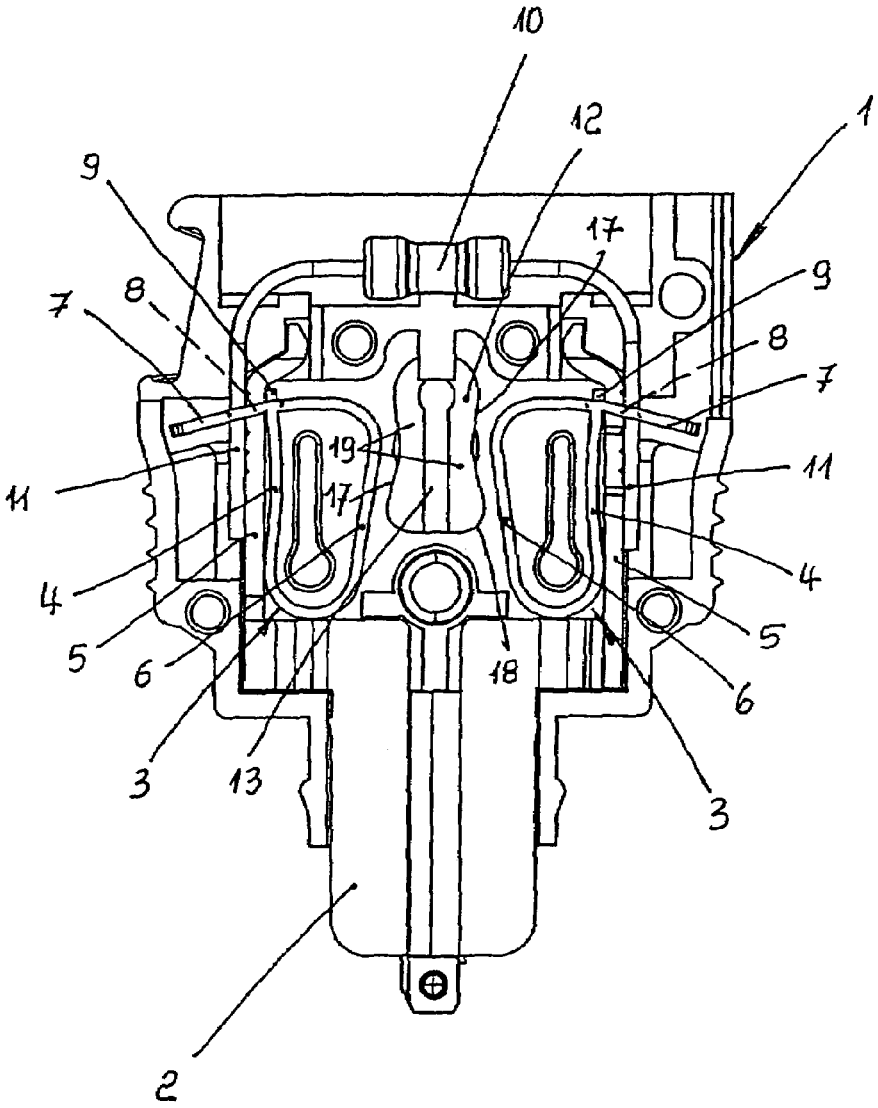
FIG. 1 is a cutaway side view of a draw spring clamp according to the present invention.

One may recognize in detail in the illustrations a clamp housing 1 on whose underside a plug element 2 is formed in order to be able to use the draw spring clamp as a plug-in module. As FIG. 1 reveals, two draw springs 3 that are positioned in mirror-image configuration. Each of these two draw springs 3 includes an attachment leg 4 that rests on a current bus 5. Made of one piece with the attachment leg 4 is a spring leg 6 that is bent into a loop along with the attachment leg 4. Thus, bent back toward the attachment leg 4, the spring leg 6 possesses a clamp leg 7 that is penetrated by a clamp window 6. The attachment leg 4 with its end 9 and the current bus 5 extend through this clamp window 8.

The two draw springs 3 provide contact for a module 10, such as an electronic component or the like, that has a cable or central region, and from which two connector cables or wires 11 correspondingly extend. Each of these wires 11 is clamped to one of the clamp positions in the area of the clamp window 8 of the draw springs 3 in that they are tensioned through the pertinent clamp window 8 by means of the spring leg 6 of the draw spring 3 against the side of the current bus 5 facing away from the attachment leg 4. The mirror-image spring legs 6 of the draw springs 3 must be tensioned with force for insertion into the clamp windows 8 and for release from the clamp positions, whereby the spring legs 6 feed in the direction toward the attachment legs 4, and correspondingly the clamp windows a are opened within the clamp legs 7 of the draw springs 3.

This actuation of the draw springs 3, namely the tensioning of their mirror-image spring legs 6, is performed simultaneously. An actuation element 12 serves for this that is positioned between the two spring legs 6 of the draw springs 3. The actuation element 12 formed longitudinally and symmetrically in the direction of the symmetry plane of the two draw springs 3 includes an insertion slot 13 into which a tool blade 14 flattened on both sides, such as a screwdriver, may be inserted. Since the actuation element 12 consists of an elastic material, and is correspondingly stretchable, the actuation element 12 may be so stretched by the tool blade 14 that force is exerted against the spring legs 6 of the draw springs 3.

In order to expand the actuation element 12, the longitudinal walls 19 of the actuation element 12 that define the insertion slot 13 and form the exterior side are elastically expandable. For one thing, the wedge force exerted by the tool blade may be used to expand the actuation element 12. If this is insufficient, such expansion of the actuation element 13 may be performed by rotation of the tool blade 14 positioned within the insertion slot 12 because the tool blade 14 rests crosswise relative to the insertion slot 13. Upon removal of the tool lade 14, the elastic actuation element automatically resets, releasing the spring leg 6.

The longitudinal exterior sides 17 of the actuation element 12 may be not merely rest points, but rather may form rest surfaces for the spring legs 6 of the draw springs 3, and may be matched to the exterior shape of the draw springs 6 in that they (as shown for the embodiment example) possess the progression of a flat recess that transforms to a rounded lower edge 18. Thus, sharp edges wedging with the exterior sides of the spring legs 6 of the draw springs 3 are avoided.

Figure 2:
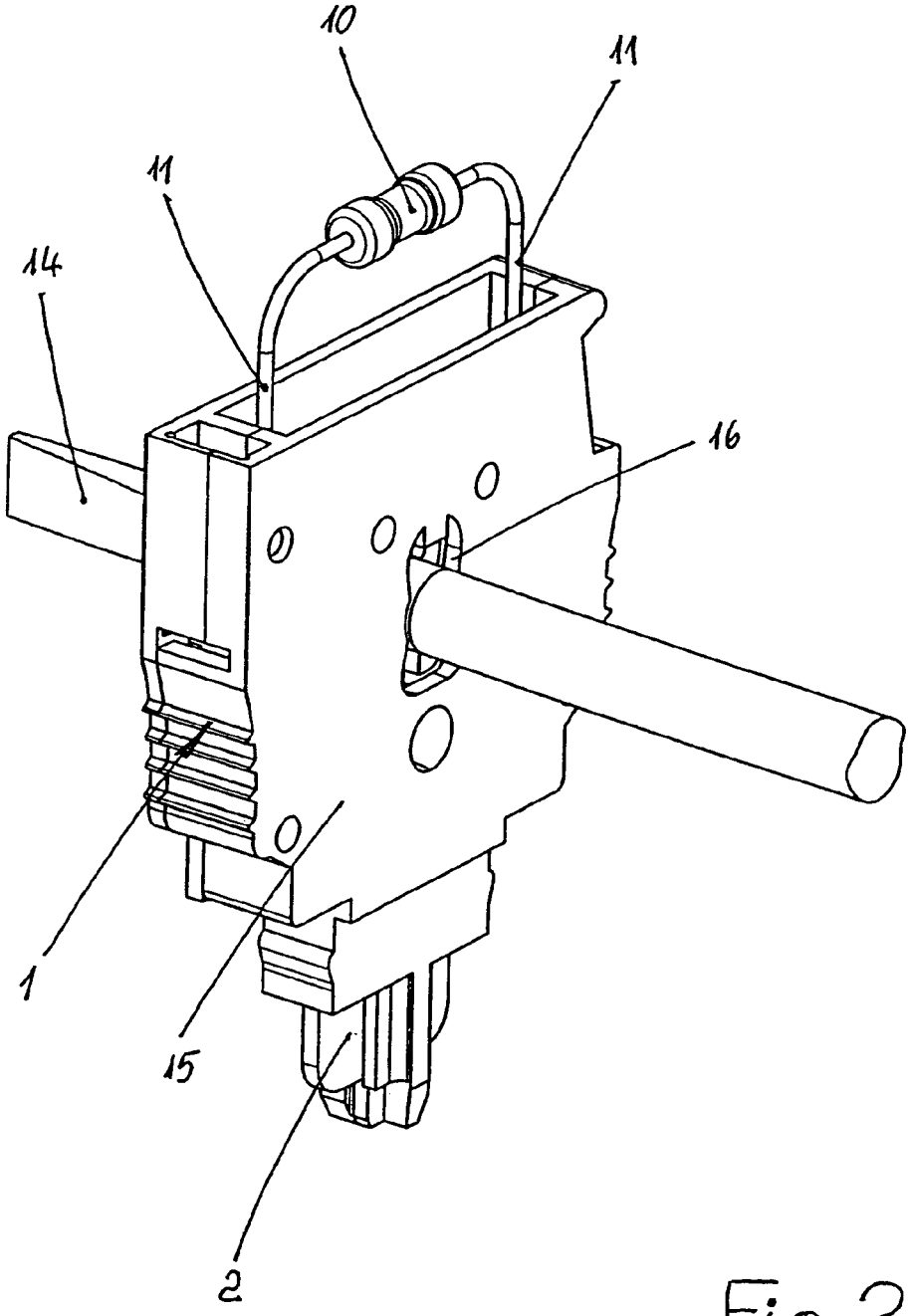
FIG. 2 is a perspective view of the draw spring clamp per FIG. 1.

FIG. 2 shows clearly that the tool blade 14 may be used from one of the broad, parallel sides of the clamp housing 1, and may even extend through the clamp housing 1. Thus, at least the pertinent wall 15 of the clamp housing 1 possesses a hole 16 through which the tool blade 11 may be inserted into the actuation element 12 behind it. The cabled module 10 is inserted with its connector cables 11 away from the open upper side of the clamp housing 1 facing away from the plug element. Thus, manipulation is practical because the inserted tool blade 14 and the connector cables 11 of the module 10 to be connected or disconnected do not interfere with each other.

As mentioned above, the present invention is not intended to be limited to a system or method which must satisfy one or more of any stated or implied object or feature of the invention and should not be limited to the preferred, exemplary, or primary embodiment(s) described herein. The foregoing description of a preferred embodiment of the invention has been presented for purposes of illustration and description. It is not intended to be exhaustive or to limit the invention to the precise form disclosed. Obvious modifications or variation are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the claims when interpreted in accordance with the breadth to which they are fairly, legally and equitably entitled.

The invention claimed is:

1. A draw spring clamp with two draw springs positioned within a housing in mirror-image configuration, each of which possesses an attachment leg resting on a current bus and a spring leg with a clamp window that is of one piece with it and that is bent together with the attachment leg into a loop, through which clamp window an end of the attachment leg and the current bus extend, whereby the two spring legs are positioned in mirror-image configuration and the spring legs may be tensioned by means of an actuation element that is positioned within a housing of the draw spring clamp, into which a tool blade may be inserted for the purpose of providing spring tension along the direction toward the attachment leg when the clamp window is opened, whereby the actuation element is located between the two mirror-image spring legs of the draw springs and rests evenly on both spring legs in the tensioned position, and possesses rest surfaces for the spring legs of both draw springs correspondingly on opposite exterior sides, of both draw springs correspondingly on opposite exterior sides, characterized in that the actuation element is formed as an elastic or partially-elastic spreading body that may be stretched toward and against both the two spring legs of the two draw spring by insertion of the tool blade using its exterior sides.

2. A draw spring clamp as in claim 1, wherein the longitudinal walls of the actuation element defining the insertion slot are elastically expandable.

3. A draw spring clamp as in claim 1, wherein the actuation element is formed and positioned to be mirror-image symmetrical to the symmetry plane of the draw springs (3).

4. A draw spring clamp as in claim 3, wherein the actuation element possesses an insertion slot longitudinal in the symmetry plane for a corresponding tool blade.

5. A draw spring clamp as in claim 4, wherein the clamp housing possesses a pass-through opening for the tool blade in at least one of two walls of the actuation element that are parallel to the hole plane off the insertion slot aligned in the direction crosswise to this hole plane with the insertion slot.

6. A draw spring clamp as in claim 1, wherein the actuation element is formed longitudinally in the direction toward the symmetry plane of the draw springs.

* * * * *